United States Patent [19]

Grimes et al.

[11] 4,173,747

[45] Nov. 6, 1979

[54] INSULATION STRUCTURES FOR ELECTRICAL INDUCTIVE APPARATUS

[75] Inventors: Jerry W. Grimes, Danville; Stephen M. Schroeder; James M. Waters, both of South Boston, all of Va.

[73] Assignee: Westinghouse Electric Corp., Pittsburgh, Pa.

[21] Appl. No.: 913,704

[22] Filed: Jun. 8, 1978

[51] Int. Cl.[2] ..... H01F 27/08

[52] U.S. Cl. ..... 336/60; 336/206

[58] Field of Search ..... 336/55, 57, 58, 60, 336/206, 185, 207, 232

[56] References Cited

U.S. PATENT DOCUMENTS

| | | | |
|---|---|---|---|
| 3,302,149 | 1/1967 | Forsha | 336/58 |
| 3,431,524 | 3/1969 | Broverman | 336/60 |
| 3,750,071 | 7/1973 | Eley | 336/232 X |
| 3,939,449 | 2/1976 | Boyd et al. | 336/60 |

*Primary Examiner*—Thomas J. Kozma
*Attorney, Agent, or Firm*—D. R. Lackey

[57] ABSTRACT

Insulation structures for use in the insulation space and with the phase barrier insulation of an electrical inductive apparatus. The insulation structures include at least one layer of spaced, vertically-extending spacer members which is surrounded on both sides by layers of electrical insulating sheet material. The insulation structures are disposed in movable relation with the adjacent windings and phase barrier insulation, thereby allowing relative movement between the windings and the insulation structures during a short circuit.

7 Claims, 6 Drawing Figures

FIG. 2
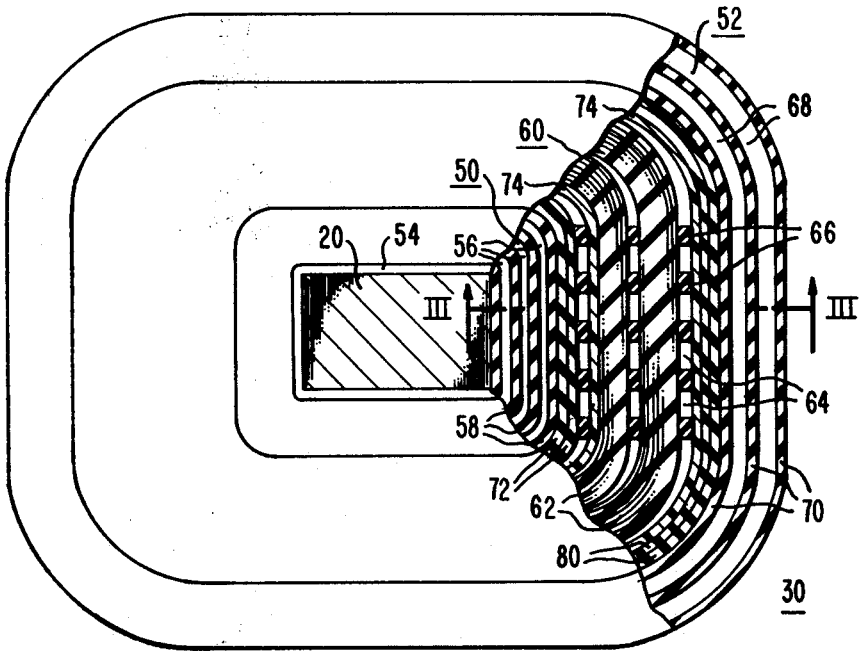
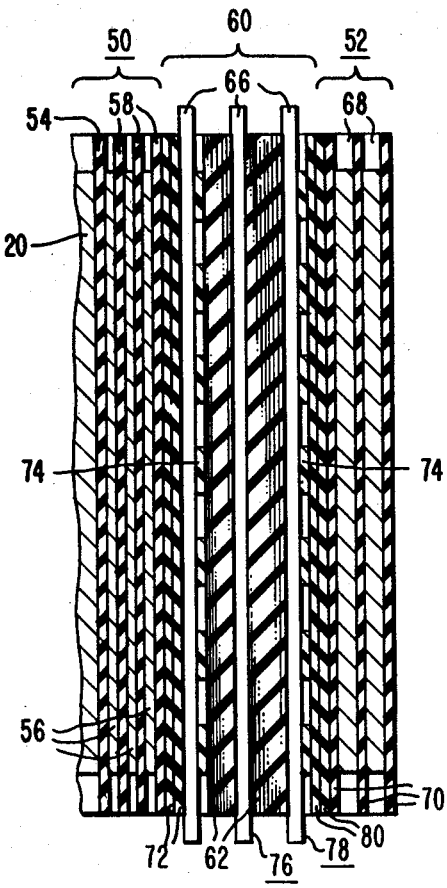
FIG. 3

INSULATION STRUCTURES FOR ELECTRICAL INDUCTIVE APPARATUS

BACKGROUND OF THE INVENTION

1. Field of the Invention

This invention relates, in general, to electrical inductive apparatus and, more specifically, to insulation structures for electrical power transformers.

2. Description of the Prior Art

It is common in electrical inductive apparatus, such as transformers, to construct a magnetic core having rectangularly-shaped leg members with electrical windings, composed of a plurality of layers of conductor turns, and also having a rectangular configuration, disposed therearound. In a two-winding rectangular core and coil configuration, the low voltage winding is normally disposed adjacent the leg of the magnetic core and the high voltage winding is wound around the high-low insulation structure separating the high voltage from the low voltage winding. The high-low insulation structure is formed of a plurality of layers of an electrically insulative sheet material built up to the thickness required to provide adequate insulation between the low voltage and high voltage windings.

As shown in U.S. Pat. No. 3,237,136, which is assigned to the assignee of the present invention, it is common to form cooling ducts in the high-low insulation space to provide additional insulation between the windings of a transformer. The cooling ducts are formed by a plurality of spacer members which are bonded to the low voltage winding and surrounded by layers of electrical insulating sheet material. It is also common to have several layers of cooling ducts in the high-low insulation space to provide fluid flow paths for dielectric fluid therebetween whose dielectric strength provides the additional insulation required for transformers having higher voltage ratings.

The rectangular core and coil type construction has been limited in the past to certain voltage and KVA ratings since larger units have been unable to meet the short circuit withstand requirements. During a short circuit, the low voltage and high voltage windings tend to separate, or move in opposite directions, with the low voltage winding being compressed against the leg of the magnetic core, and the high voltage winding being subject to an outward tensile force. This separation of the low voltage from the high voltage windings during a short circuit causes considerable force to be exerted on the cooling ducts within the insulation space which are bonded to the windings. This force breaks the adhesive bonds holding the spacer members in position or rips the spacer members, which are typically formed of cellulosic material such as pressboard, thereby causing misalignment of the spacers which blocks coolant flow through the ducts and decreases the insulative strength of the high-low insulation structure. Further, the severe forces may cause the spacer members to penetrate the adjacent layers of insulative sheet material, thereby lowering its insulative properties and decreasing the short circuit withstand capability of the transformer.

In a rectangular core and coil configuration, the sides of the rectangular coils are compressed against an insulative barrier, which is compressed against another coil or against the framing structure surrounding the magnetic core and coil assembly. According to the prior art, the insulative barrier consists of solid insulative material, such as pressboard, of suitable thickness which is surrounded on both sides, in high voltage rated apparatus, by a plurality of spaced, vertically-extending spacer members. The spacer members, which form a plurality of cooling ducts therebetween, are disposed in contact with the outermost turns of the adjacent winding assemblies or the support structure surrounding the core and coil assembly. During a short circuit, there is a vibratory force transmitted from one phase to the adjacent phase or to the support structure. This force is sufficient to break the adhesive bonds holding the spacer members to the solid insulating material forming the barrier insulation, thereby resulting in misalignment of the spacer members, which blocks dielectric fluid flow through the cooling ducts in the phase barrier insulation structures and decreases its insulative properties.

Thus, it is desirable to provide an electrical inductive apparatus having improved insulation structures that retain their physical integrity under the forces exerted on the electrical inductive apparatus during short circuit conditions. It is also desirable to provide an electrical inductive apparatus which permits relative movement between the insulation structures and the adjacent windings or barrier insulation to prevent damage to the spacer members forming the cooling ducts within the insulation structures. Finally, it is desirable to provide an electrical inductive apparatus having insulation structures in which the spacer members forming cooling ducts therein are securely held in a vertical orientation throughout the operation of the apparatus.

SUMMARY OF THE INVENTION

Briefly, the present invention is a new and improved insulation structure for an electrical inductive apparatus, such as a power transformer. The novel insulation structure is adapted for use in the insulation space between the high and low voltage windings and with the phase barrier insulation between adjacent electrical winding phases or between the outermost winding phases and the support structure surrounding the magnetic core and coil assembly. The insulation structure has a unique arrangement that resists breakage of the spacers used to form the cooling ducts that is typically caused by forces exerted on the windings during a short circuit. The insulation structure is decoupled or movably disposed from the adjacent portions of the windings and the phase barrier insulation, thereby permitting relative movement between the insulation structure and the adjacent windings and phase barrier insulation during a short circuit which minimizes breakage of the spacers forming the cooling ducts.

The insulation structure includes at least one layer of spaced, vertically-extending spacer members which form a plurality of passages therebetween for the flow of dielectric fluid through the insulation structure. The spacers are surrounded on both sides by at least one layer of electrical insulating sheet material which is completely free of curable adhesive material so as to be movably disposed from the adjacent windings or phase barrier insulation such that relative movement is permitted between the insulation structure and the adjacent windings when the windings move under the forces incident to a short circuit.

The spacer members are securely held in position through the use of a B-stage adhesive coating disposed on at least one side of the spacers and by a plurality of turns of an electrical insulating, B-staged adhesive impregnated, strip material which is wound around the spacers. After curing, the adhesive coating on the spacers and in the strip material polymerizes to a solid state to cohesively bond the spacers to the adjacent layers of electrical insulating material and thereby maintain the spacers in a vertical orientation throughout the operation of the transformer.

However, since the outer layers of insulating material surrounding the spacers are not bonded to the adjacent windings or phase barrier insulation, the entire insulation structure is free to move relative to the windings when the windings are subjected to the forces incident to a short circuit. In this manner, the insulation structure does not experience the forces exerted on the windings during a short circuit, as in prior art constructions wherein the insulation structure is solidly joined to the adjacent windings, which minimizes breakage of the spacers which heretofore have destroyed the physical integrity of the insulation structure and degraded its insulative characteristics.

BRIEF DESCRIPTION OF THE DRAWING

The various features, advantages and other uses of this invention will become more apparent by referring to the following detailed description and drawing, in which:

FIG. 2 is a plan view of one of the electrical winding assemblies shown in FIG. 1, with a portion cut away for clarity;

FIG. 3 is a sectional view, generally taken along line III—III in FIG. 2, showing the electrical winding assembly;

DESCRIPTION OF THE PREFERRED EMBODIMENT

Figure 1:
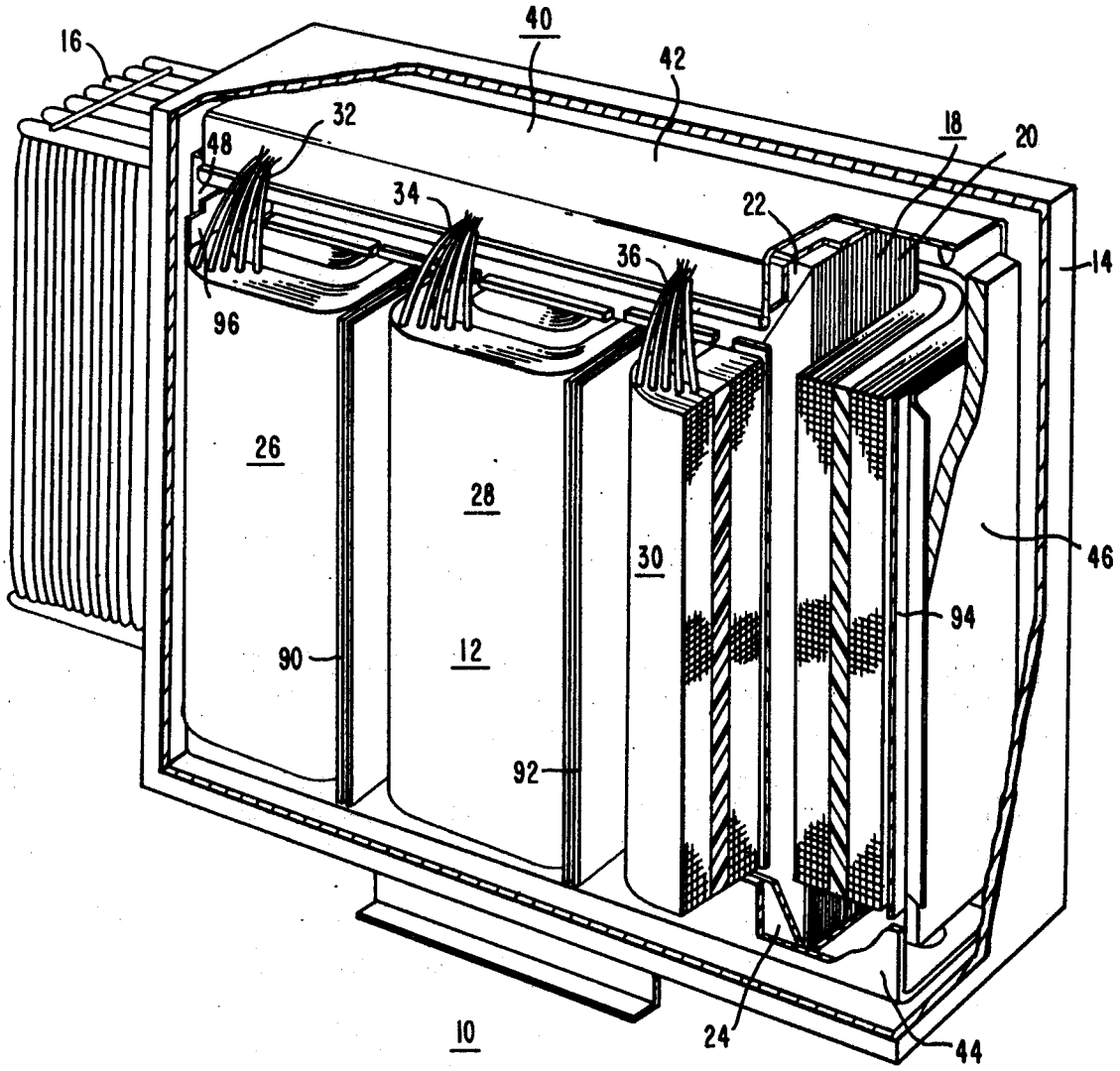
FIG. 1 is a perspective view of an electrical inductive apparatus constructed according to the teachings of this invention, with a portion of the winding structure cut away for clarity.

Throughout the following description, identical reference numbers refer to the same component or member shown in all figures of the drawing.

Referring now to the drawing, and to FIG. 1 in particular, there is shown an electrical inductive apparatus 10, such as a power transformer, constructed according to the teachings of this invention. The electrical inductive apparatus 10 consists of a magnetic core and winding assembly 12, which is disposed in a suitable tank or enclosure 14. A dielectric fluid, not shown, would normally fill the tank 14 and radiator 16 to provide sufficient cooling and insulation of the magnetic core and winding assembly 12.

The magnetic core and winding assembly 12 includes a magnetic core 18 constructed of a plurality of laminations of suitable magnetic material. The magnetic core 18 is formed of a plurality of horizontally-spaced, vertically-extending leg portions, such as leg portion 20, which connect to top and bottom yoke portions 22 and 24, respectively, to complete the magnetic circuit. In addition, the leg portions preferably have a rectangular cross-sectional configuration.

The magnetic core and winding assembly 12 further includes electrical phase windings 26, 28 and 30, which are respectively disposed in inductive relation with the leg portions of the magnetic core 18. The phase winding assemblies 26, 28 and 30 include concentric low voltage and high voltage windings each formed of a plurality of layers of conductor turns, arranged in a rectangular cross-sectional configuration and leads 32, 34 and 36, which respectively connect the electrical winding assemblies 26, 28 and 30 to an external electrical circuit through bushings, not shown. Although a three-phase magnetic core and winding assembly is illustrated, it will be understood that the teachings of this invention apply equally as well to single phase power transformers.

The magnetic core and winding assembly 12 is held rigidly in position by a suitable support structure 40 formed of upper and lower end frames 42 and 44, respectively, and first and second end plates 46 and 48, respectively, which are joined together to provide a rigid structure that resists movement of the windings during the operation of the transformer 10. The components of the upper and lower end frames 42 and 44, respectively, are disposed in registry with the top and bottom yokes 22 and 24 of the magnetic core 18 and are welded together under pressure to form a rigid structure that exerts a clamping action on the top and bottom yokes 22 and 24 of the magnetic core 18. The first and second end plates 46 and 48 are disposed in registry with a portion of the outermost turns of the outer phase windings 26 and 30 and are welded at their top and bottom ends to the upper and lower end frames 42 and 44, respectively, to provide the rigid support structure for the magnetic core and winding assembly 12.

Referring now to FIGS. 2 and 3, there are shown detailed views of one of the identical winding assemblies, such as electrical winding assembly 30. The electrical winding assembly 30 consists of a low voltage winding 50 and a high voltage winding 52, each formed of a plurality of layers of conductor turns, which are concentrically disposed about leg portion 20 of the magnetic core 18. In the conventional rectangular core and winding assembly configuration, the low voltage winding 50 is disposed adjacent the leg 20 of the magnetic core 18 and is wound around an insulating winding tube 54. The low voltage winding 50 is formed of a suitable electrical conductor of either sheet, strap or wire type, with sheet being preferred, since it essentially eliminates the vertical forces exerted on the conductor during a short circuit. A sheet 58 of electrical insulating material is wound with the electrical conductor 56 and provides adequate insulation between adjacent layers of the electrical conductor 56 forming the low voltage winding 50. The electrically insulating sheet material 58 is formed of thermally stabilized insulating paper having a discontinuous coating of an adhesive, such as an epoxy, phenolic, epoxy-phenolic or other suitable resin, which is in the "B" stage, disposed at discrete locations on at least one side thereof. The "B" stage resin coating is tack-free at ambient temperature, becomes soft and flows at elevated temperatures and then permanently sets to cohesively bond adjacent layers of electrical conductor 56 together in a solid mass. Although one layer of the electrical insulating sheet material 56 is illustrated between adjacent layers of the conductor 56, it will be understood that additional layers or a single layer of greater thickness of the electrical insulating sheet material 58 may be utilized between adjacent layers of the conductor 56 to provide additional amounts of layer insulation therebetween.

An insulation structure 60, described in detail hereafter, is wound around the low voltage winding 50. The insulation structure 60 generally includes a plurality of layers of electrical insulating sheet material 62, which may have a B-staged adhesive coating thereon, built-up to a predetermined thickness to provide adequate insulation between the low voltage and high voltage windings 50 and 52, respectively. Further, the insulation structure 60 includes a plurality of cooling ducts which provide fluid flow passages for the flow of dielectric flow therethrough, which increases the insulative properties of the insulation structure 60. The cooling ducts 64 are formed by a plurality of circumferentially-spaced, vertically-extending spacer members 66 which are arranged in one or more concentric layers, depending upon cooling and insulation requirements in a particular application.

The high voltage winding 52 is wound around the insulation structure 60 and is formed by a plurality of layers of turns of a suitable electrical conductor 68, which may be either sheet, strap or wire type, with strap being illustrated. The conductor 68 is covered with a suitable insulative material, not shown, such as paper, to provide adequate insulation between adjacent turns of a conductor 68. In addition, layers of an electrically insulative sheet material 70 having a "B" stage coating of a suitable adhesive disposed at discrete locations on at least one side thereof, are wound with the conductor 68 to provide sufficient insulation between adjacent layers of the electrical conductor 68 forming the high voltage winding 52.

Although the electrical winding assembly 30 is illustrated as consisting of low and high voltage windings 50 and 52, respectively, it will be understood that other winding configurations, such as a split low voltage winding configuration or a series-multiple arrangement, wherein either or both of the low and high voltage windings are divided into several discrete sections, may be utilized as well.

After the winding assembly is wound, it is heated at a predetermined temperature for the necessary time to cure the resin coating on the insulative sheet material 58 and 70. During this time, the adhesive on the insulating sheet material 58 and 70 becomes soft and flows and then permanently hardens to bond the various layers of the low and high voltage windings 50 and 52 and the insulative sheet material 58 and 70 therebetween together in a solid, coherent unit.

During its operation, the transformer 10 is subjected to severe forces incident to short circuit and transient conditions. These severe forces compress the low voltage winding 50 inwardly against the leg 20 of the magnetic core 18 and exert an outward tensile force on the high voltage winding 52, thereby tending to separate or move the low and high voltage windings 50 and 52, respectively, in opposite directions. This separation of the low and high voltage windings 50 and 52 during a short circuit exerts severe separation forces on the cooling ducts within the insulation structure 60, which, in a conventionally constructed transformer, is solidly bonded to the low and high voltage windings 50 and 52, respectively. These separation forces cause breakage of the adhesive bonds holding the spacers 66 in position or rip the spacers 66 apart, thereby resulting in misalignment of the spacers 66, which may block a portion of the cooling ducts 64, thereby decreasing the insulation properties of the insulation structure 60 and degrading the electrical performance of the transformer. In addition, the separation forces exerted on the insulation structure 60 may cause the broken spacers 66 to penetrate and tear the adjacent layers of sheet material 62 which degrades the insulating properties of the sheet material 62, again resulting in a degradation in the electrical performance of the transformer 10.

It is the purpose of this invention to provide an electrical inductive apparatus having improved insulation structures which resist breakage of the spacers forming the cooling ducts caused by the severe forces acting thereon incident to short circuit conditions in transformers having high KVA and voltage ratings. In general, the insulation structure is disposed in movable relation from the adjacent windings which permits relative movement of the insulation structure, and of the cooling ducts contained therein, from either the low or high voltage windings. Thus, during a short circuit, which compresses the low voltage winding against the leg of the magnetic core and exerts an outward tensile force on the high voltage winding, the insulation structure, being movably disposed or not joined to the high and low voltage windings, does not experience the separation forces exerted on conventionally constructed insulation arrangements which minimizes breakage of the spacers utilized to form the cooling ducts in the insulation structure, and thereby maintains the integrity of the insulation structure throughout the operation of the transformer.

According to the teachings of this invention, the insulation structure 60 is decoupled or movably disposed from both the low and high voltage windings 50 and 52, respectively, by winding at least two layers of electrical insulating sheet material 72, which is completely free of any curable adhesive on the adjoining surfaces therebetween around the outermost turn of the low voltage winding 50. Although the innermost layer of the uncoated sheet material 72 will be cohesively bonded to the outer layer of sheet material 58 surrounding the low voltage winding 50 due to the adhesive coating thereon, the outer layer of the sheet material 72 remains decoupled therefrom, which allows relative movement between the low voltage winding 50 and the insulating structure 60. Next, a layer of circumferentially-spaced, vertically-extending spacer members 66 is disposed around the outer layer of the insulative sheet material 72. The spacer members 66, which are conventionally formed of cellulosic material, such as pressboard, are spaced apart to provide for the flow of a dielectric adequate therebetween fluid passages. Although not shown, the spacer members 66 are normally held together by horizontally-extending strips which are bonded thereto to simplify the assembly of the spacer members 66 around the low voltage winding 50.

Means are also provided for securely maintaining the spacer members 66 in a vertical orientation and include a coating of "B" stage adhesive resin on at least the side of each spacer member 66 disposed adjacent to the uncoated sheet material 72. When cured, this adhesive coating cohesively bonds the spacer members 66 to the outermost layer of the uncoated sheet material 72 and maintains the spacer members 66 in the desired vertical orientation. A stronger bond may be provided to maintain the spacers 66 in the desired vertical orientation by wrapping a plurality of turns of an electrically-insulating, adhesive-impregnated strip material 74 around the spacer members 66. According to the preferred embodiment of this invention, the strip material 74 consists of a glass-fiber polyester tape which is impregnated with a "B" stage epoxy resin. After curing, the "B" stage epoxy resin in the strip material 74 cohesively bonds the strip material 74 to the spacer members 66 and to the adjacent layer of insulating material, thereby providing additional mechanical strength to maintain the spacer members 66 in the desired vertical orientation throughout the operation of the transformer 10. Next, a plurality of layers of an electrical insulating sheet material 62, which may have a "B" stage adhesive material disposed at discrete areas on at least one side thereof, are wound around the spacer members 66 and tape 74 to a predetermined thickness, generally between five and fifteen mils to provide adequate insulation between the low and high voltage windings 50 and 52, respectively.

For transformers having higher voltage ratings, it is necessary to provide additional insulation build-up in the insulation structure 60. Thus, additional layers of the spacer members 66, such as layers 76 and 78, with an appropriate build-up of electrical insulative material sheet 62 disposed therebetween are wound around the first layer of spacer members 66 and electrical insulative material sheet 62 disposed therearound. In each instance, the spacer members 66 in layers 76 and 78 have a "B" stage adhesive coating on one side thereof, with the outer layer 78 being surrounded by a plurality of turns of the epoxy-impregnated glass tape 74.

In order to decouple the cooling duct and insulating structure 60 from the adjacent high voltage winding 52, an additional two layers 80 of electrical insulating sheet material, having no curable adhesive at the interface therebetween, are wound around the outermost layer 78 of spacer members 66. Then, the high voltage winding 52, comprising alternating layers of adhesive coated insulative sheet material 70 and conductor turns 68 are wound around the insulative structure 60 to complete the electrical phase winding assembly. Although the outer layer of the non-adhesive coated insulative sheet material 80 becomes cohesively bonded to the inner layer 70 of adhesive coated sheet material in the high voltage winding 52, the innermost layer of the non-adhesive coated sheet material 80 adjacent the spacer members 66 is decoupled therefrom, which permits relative movement between the insulation structure 60 and the high voltage winding 52 when the transformer 10 is subjected to forces incident to a short circuit or transient condition.

It should be noted that the use of two layers of electrical insulating material surrounding the spacers 66 is required when the layer of insulative material surrounding the adjacent winding has an adhesive coating thereon. In those transformer constructions in which the insulative material surrounding the winding is free of curable adhesive or has no insulation at all, only one layer of insulative material is required to decouple or movably dispose the insulation structure from the adjacent winding and permit relative movement therebetween.

Figure 6:
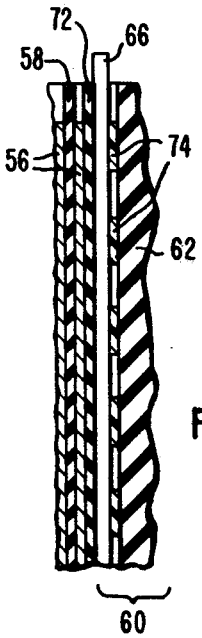
FIG. 6 is a fragmentary sectional view similar to FIG. 3 showing another embodiment of this invention.

As shown in FIG. 6, the outermost turn of the low voltage winding 56 is not covered by a layer of insulative material as in FIGS. 2 and 3. Thus, only one layer 72 of electrical insulative material, which is completely free of curable adhesive material on the surface adjacent to the winding 56, is needed to movably dispose or decouple the insulation structure 60 from the winding 56. The same construction may also be used to decouple the insulation structure 60 from the high voltage winding or the phase barrier insulation.

As noted previously, during a short circuit, the low voltage winding 50 is compressed inwardly against the leg 20 of the magnetic core 18; while the high voltage winding 52 is subjected to an outward tensile force. Since the insulative structure 60 is decoupled from both the low and high voltage windings 50 and 52, respectively, the low and high voltage windings 50 and 52 are free to move relative to the insulative structure 60, which minimizes breakage of the spacer members 66 or the adhesive bonds holding them in the desired vertical orientation since the insulative structure 60 is not subjected to the forces incident to the short circuit. Furthermore, the spacers 66 are cohesively bonded to the adjacent layers of insulative sheet material by the cured adhesive coating on the individual spacer members 66 and by the plurality of turns of epoxy impregnated glass strip material 74 disposed around the spacer members 66. This structure maintains the spacer members 66 in the desired vertical orientation throughout the operation of the transformer 10, which maintains the physical integrity of insulation structure 60 between the low and high voltage windings 50 and 52, respectively, of the phase winding assembly 30.

The decoupled insulation structure 60 described above may also be used to advantage with the phase barrier insulation. Referring again to FIG. 1, it will be seen that solid insulating means 90 and 92 are employed between the phase winding assemblies 26, 28 and 30 and solid insulation means 94 and 96 are disposed between the outermost winding assemblies 30 and 26, respectively, and the adjacent end plates 46 and 48 of the support structure 40 to provide adequate insulation therebetween and a solid, substantially non-movable structure.

Figure 4:
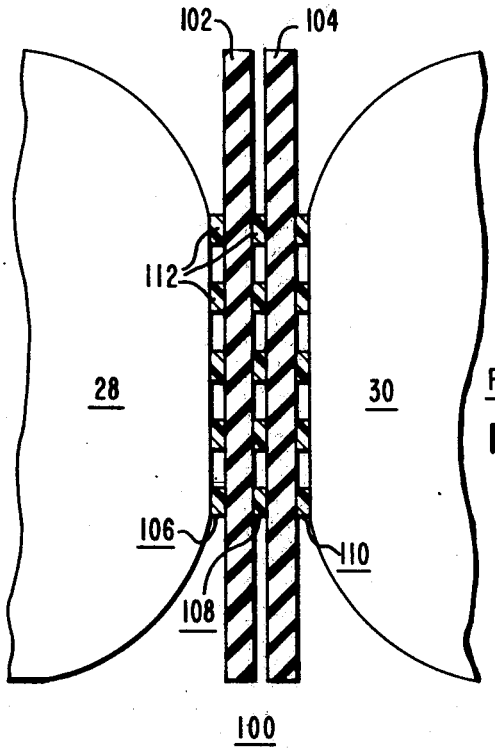
PRIOR ART FIG. 4
FIG. 4 is a plan view of a typical phase barrier insulation structure constructed according to the teachings of the prior art.

Referring now to FIG. 4, there is shown a conventional prior art phase barrier insulation structure 100 which may be used between the phase winding assemblies or between the outermost phase winding assemblies and the support structure. As shown therein the phase barrier insulation structure 100 includes solid insulating means 102 and 104, which may be constructed of any suitable insulative material, such as pressboard or a material sold commercially under the trademark "Micarta", having a predetermined thickness to provide the necessary insulation between the high voltage windings of adjacent phase winding assemblies, such as phase winding assemblies 28 and 30. A plurality of layers 106, 108 and 110 of spaced, vertically-extending spacer members 112 are disposed on either side of, and bonded to, the sheets of insulative material 102 and 104 to provide fluid passages for dielectric fluid whose dielectric strength adds to the insulation properties of the solid insulating means 102 and 104. Although the phase barrier structure 100 illustrated includes multiple layers of solid insulating material 102 and 104 to provide adequate insulation for high KVA rated transformers, it will be understood that transformers having lower voltage ratings would need only one layer of solid insulating material, such as layer 102, surrounded by cooling ducts to provide adequate insulation between the adjacent phase winding assemblies 28 and 30.

Incident to a short circuit, a force is transmitted from phase to phase and from the outermost phases to the adjacent portions of the support structure 40 which vibrates due to the 60 Hz. alternating current frequency.

This vibratory force breaks the bonds holding the spacer members 112 to the solid insulating material 102 and 104 disposed therebetween, and may cause breakage and misalignment of the spacers 112, which blocks the cooling ducts and damages the physical integrity of the phase barrier insulation.

Figure 5:
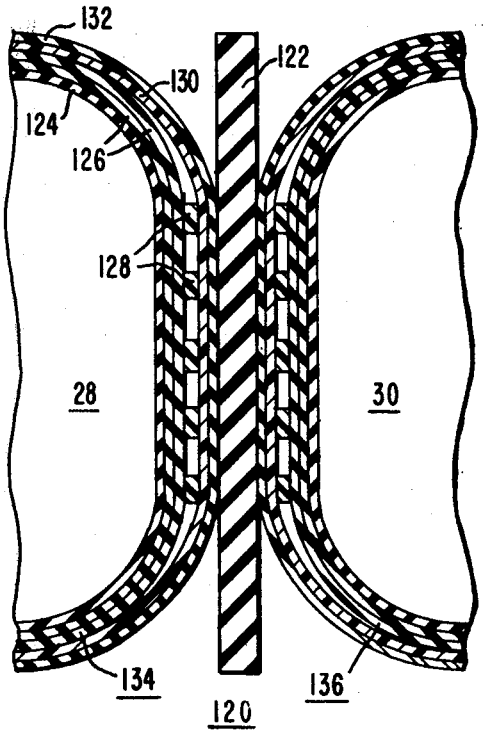
FIG. 5 is a plan view of a phase barrier insulation structure constructed according to the teachings of this invention.

In order to prevent damage to the spacers in the phase barrier insulation structures of the transformer 10, it is proposed to decouple the spacers forming the cooling ducts from both the adjacent high voltage winding and the phase barrier insulation so as to permit relative movement therebetween. There is shown in FIG. 5 a phase barrier insulation structure 120 associated with insulation structures 134 and 136 constructed according to the teachings of this invention. The phase barrier insulation includes solid insulating means 122 constructed of suitable insulating material, such as pressboard or Micarta, which is disposed between adjacent phase winding assemblies, such as phase winding assemblies 28 and 30. Since the novel insulation structure to be described hereafter is identical for phase winding assemblies 28 and 30, only the insulation structure 134 associated with phase winding assembly 28 will be described in detail. Accordingly, a layer of electrically insulating sheet material 124 having "B" stage adhesive material disposed at discrete locations on at least one side thereof is wrapped around the outermost turns of the high voltage winding of phase winding assembly 28. Two layers 126 of non-adhesive coated, electrical insulating sheet material are wrapped around the layer of insulative sheet material 124 surrounding the high voltage winding of the phase assembly 28. As with the insulation structure 60 in the high-low insulation space, only one layer of insulating material 126 is required if the high voltage winding 28 is not covered with insulation or is covered by insulation which is free of curable adhesive on its outer surface. A plurality of spaced, vertically-extending spacer members 128 are disposed in contact with the outermost layer of the non-adhesive coated sheet material 126 and secured in position by either having a coating of "B" stage adhesive material on the inner surface thereof or, additionally, by having a plurality of turns of the epoxy-impregnated glass strip material 130 disposed therearound. In either case, upon curing of the transformer, the "B" stage epoxy resin on the surface of the spacer members 128 or in the strip material 130 cohesively bonds the spacer members 128 to the outer layer of the non-coated insulative sheet material 126 and maintains the spacer members 128 in the desired vertical orientation. Finally, a layer of electrically insulating sheet material 132 is disposed around the adhesive impregnated strip material 130 to complete phase winding assembly 28. A similar insulation structure is provided for phase winding assembly 30. The solid insulating means 122, having a suitable thickness, is disposed between the adjacent portions of the phase winding assemblies 28 and 30 to provide adequate insulation therebetween.

As noted previously, the high voltage windings of the phase winding assemblies 28 and 30 will be subjected to an outward tensile force incident to a short circuit condition on the transformer 10. This outward force will drive the high voltage windings of the phase winding assemblies 28 and 30 and the cooling duct structures disposed on the outer end portions thereof against the solid insulating means 122 in a vibratory manner due to the 60 Hz. alternating current frequency. However, since the insulation structures 134 and 136 in each winding assembly 28 and 30 have cooling ducts therein which are decoupled from the respective high voltage windings of the phase winding assemblies 28 and 30 and from the solid insulating means 122, relative movement between the insulation structures 134 and 136 and either the high voltage windings or the solid insulation means 122 is permitted, which minimizes the effect of the forces transmitted between the phase windings during a short circuit condition. Furthermore, the spacer members 128 forming the cooling ducts around the flat, side portions of the phase winding assemblies 28 and 30 are held or maintained solidly in the desired vertical orientation through the use of the adhesive coating on the surface of the spacer members 128 or, additionally, by the plurality of turns of adhesive impregnated, electrically insulating strip material 130 disposed around the spacer members 128, which prevents breakage and subsequent misalignment of the spacer members 128 that damages the physical integrity of the insulation structure in this region of the transformer 10.

In summary, there is disclosed herein an electrical inductive apparatus having a new and improved insulation structure suitable for use in the insulation space between the low and high voltage windings and with the phase barrier insulation between adjacent electrical phase winding assemblies or between the phase winding assemblies and the adjacent portions of the support structure. The unique construction of the insulation structure resists breakage of the spacers used to form the cooling ducts therein caused by forces incident to a short circuit. The insulation structure is movably disposed with respect to the adjacent windings or phase barrier insulation, thereby permitting relative movement therebetween which minimizes breakage of the spacers used to form the cooling ducts and maintains the physical integrity of the insulation structure.

What is claimed is:

1. Electrical inductive apparatus comprising:

a tank;

dielectric fluid disposed in said tank to cool and electrically insulate said electrical inductive apparatus;

a magnetic core having a plurality of horizontally-spaced, vertically-extending leg portions connecting first and second yoke portions disposed in said tank;

a plurality of electrical winding assemblies disposed in inductive relation with said leg portions of said magnetic core and having a substantially rectangular cross-sectional configuration;

a support structure disposed in registry with said magnetic core and said electrical winding assemblies to provide a solid structure that resists movement of said electrical winding assemblies;

solid insulation means disposed between at least the adjacent portions of said electrical winding assemblies and between adjacent portions of said electrical winding assemblies and said support structure to provide insulation therebetween;

each electrical winding assembly including concentric first and second electrical windings, each formed of a plurality of layers of conductor turns, said first and second electrical windings being subject to radial movement under forces incident to a short circuit; and insulation structures disposed between certain of said first and second windings in said electrical winding assemblies and between said electrical winding assemblies and said solid insulating means and in movable relation therewith to permit relative movement between said insulation structures and said windings under forces exerted on said windings during a short circuit;

each of said insulation structures including a plurality of spaced, vertically extending spacer members arranged in a first layer and forming a plurality of passages for the flow of said dielectric fluid therethrough, at least one layer of electrical insulating material disposed on each opposing side of said spacer members with each of said layers of electrical insulating material being unbonded to adjacent portions of said windings and said solid insulating means so as to permit relative movement therebetween, and means for securing said spacer members to said layers of electrical insulating material to form a solid structure that maintains said spacer members in a vertical orientation throughout the operation of said electrical inductive apparatus.

2. The electrical inductive apparatus of claim 1 wherein the means for securing the spacer members includes said spacer members having a coating of a B-staged adhesive material disposed thereon.

3. The electrical inductive apparatus of claim 1 wherein the means for securing the spacer members includes a plurality of turns of an electrical insulating, B-staged adhesive impregnated, strip material disposed around said spacer members which forms cohesive bonds between said spacers and adjacent layers of said insulating material when said adhesive is polymerized to a solid state.

4. The electrical inductive apparatus of claim 3 wherein the electrical insulating B-staged adhesive impregnated strip material is a B-staged epoxy resin impregnated, glass fiber tape.

5. The electrical inductive apparatus of claim 1 wherein the insulation structure includes two layers of electrical insulating material disposed between the spacer members and the adjacent portions of the windings, said two layers of electrical insulating material being completely free of curable adhesive material at the interface between adjoining surfaces thereof such that relative movement is permitted between said two layers of electrical insulating material.

6. The electrical inductive apparatus of claim 1 wherein the insulation structure further includes a second layer of spaced, vertically-extending spacer members radially spaced from the first layer of spacer members, and a plurality of layers of electrical insulating material disposed between said first and second layers of spaced members.

7. A power transformer comprising:

a tank;

a dielectric fluid disposed in said tank to cool and insulate said transformer;

a magnetic core having a plurality of horizontally-spaced, vertically-extending leg portions of rectangular cross-section connecting first and second yoke portions disposed in said tank;

a plurality of electrical winding assemblies disposed in inductive relation with said leg portions of said magnetic core and having a substantially rectangular cross-sectional configuration;

a support structure disposed in registry with said magnetic core and said electrical winding assemblies to provide a solid structure that resists movement of said electrical winding assemblies;

solid insulation means disposed between at least the adjacent portions of said electrical winding assemblies and between adjacent portions of said electrical winding assemblies and said support structure to provide insulation therebetween;

each of said electrical winding assemblies including concentric first and second electrical windings, each formed of a plurality of layers of conductor turns, said first and second electrical windings being subject to radial movement under forces incident to a short circuit; and each of said electrical winding assemblies including first and second insulation structures, said first insulation structure being disposed between said first and second electrical windings and said second insulation structure being disposed between said second electrical winding and adjacent portions of said solid insulation means;

said first and second insulation structures being disposed in movable relation with respect to said first and second electrical winding and said solid insulating means, respectively, to permit relative movement between said first and second insulation structures and said first and second windings and said solid insulating means under forces exerted on said windings during a short circuit;

each of said first and second insulation structures including a plurality of spaced, vertically extending spacer members arranged in a first layer and forming a plurality of passages for the flow of said dielectric fluid therethrough, at least one layer of electrical insulating material being disposed on each opposing side of said spacer members with each of said layers of electrical insulating material being unbonded to adjacent portions of said windings and said solid insulating means so as to permit relative movement therebetween;

said spacers being securely held in a vertical orientation to said layers of electrical insulating material by a B-staged adhesive coating on the surface of said spacers and a plurality of turns of a B-staged adhesive impregnated, electrical insulating strip material disposed around said spacers, which adhesive, when cured, cohesively bonds said spacers to said adjacent layers of said electrical insulating material.

* * * * *